US008462185B2

(12) United States Patent
Iguchi et al.

(10) Patent No.: US 8,462,185 B2
(45) Date of Patent: Jun. 11, 2013

(54) RECORDING MEDIUM REMOVING APPARATUS, ERASING APPARATUS, AUTOMATIC DOCUMENT FEEDING APPARATUS, AND RECORDING MEDIUM REMOVING METHOD

(75) Inventors: Ken Iguchi, Shizuoka (JP); Isao Yahata, Shizuoka (JP); Takahiro Kawaguchi, Shizuoka (JP); Hiroyuki Taguchi, Shizuoka (JP); Hiroyuki Tsuchihashi, Shizuoka (JP); Hiroyuki Taki, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 286 days.

(21) Appl. No.: 13/038,188

(22) Filed: Mar. 1, 2011

(65) Prior Publication Data

US 2011/0221849 A1 Sep. 15, 2011

Related U.S. Application Data

(60) Provisional application No. 61/314,111, filed on Mar. 15, 2010, provisional application No. 61/314,113, filed on Mar. 15, 2010.

(51) Int. Cl.

| | |
|---|---|
| ***B41J 2/325*** | (2006.01) |
| ***B65H 7/02*** | (2006.01) |
| ***B65H 29/62*** | (2006.01) |
| ***B65H 43/04*** | (2006.01) |

(52) U.S. Cl.
USPC ..... 347/179; 347/218

(58) Field of Classification Search
USPC ..... 347/177, 179, 218, 101, 104, 262, 347/264
See application file for complete search history.

(56) References Cited

U.S. PATENT DOCUMENTS

| | | | | |
|---|---|---|---|---|
| 7,809,308 | B2 * | 10/2010 | Sekiya | 399/124 |
| 8,292,287 | B2 * | 10/2012 | Iguchi et al. | 271/9.08 |
| 2010/0321457 | A1 * | 12/2010 | Kawaguchi et al. | 347/179 |
| 2011/0033216 | A1 * | 2/2011 | Taki et al. | 399/341 |
| 2011/0221848 | A1 * | 9/2011 | Taki et al. | 347/179 |
| 2011/0221850 | A1 * | 9/2011 | Kawaguchi et al. | 347/179 |

* cited by examiner

*Primary Examiner* — Huan Tran
(74) *Attorney, Agent, or Firm* — Patterson & Sheridan, LLP

(57) ABSTRACT

According to one embodiment, an erasing apparatus including a recording medium removing apparatus includes: a thickness determining unit configured to determine whether the thickness of a recording medium is equal to or larger than a first threshold, a conveyance guide forming a conveying path for the recording medium; a conveyance guide displacing device configured to lift the conveyance guide if the thickness determining device determines that the thickness of the recording medium is equal to or larger than the first threshold, and a removing mechanism configured to remove, from a recording medium conveying path, the recording medium determined as unconveyable.

25 Claims, 11 Drawing Sheets

RECORDING MEDIUM REMOVING APPARATUS, ERASING APPARATUS, AUTOMATIC DOCUMENT FEEDING APPARATUS, AND RECORDING MEDIUM REMOVING METHOD

CROSS-REFERENCE TO RELATED APPLICATIONS

This application is based upon and claims the benefit of priority from the prior U.S. Patent Application No. 61/314,111, filed on Mar. 15, 2010, and the prior the U.S. Patent Application No. 61/314,113, filed on Mar. 15, 2010, and the entire contents of which are incorporated herein by reference.

FIELD

Embodiments described herein relate generally to a recording medium removing apparatus, an erasing apparatus, an automatic document feeding apparatus, and a recording medium removing method.

BACKGROUND

For saving of resources, in some case, image formation is performed using erasable developing materials. As the erasable developing materials, there are toner, ink, and the like erased by heat. Recording media on which images are formed with such erasable developing materials are reused after being heated by an erasing apparatus to have the images erased from the recording media.

However, recording media inserted into the erasing apparatus are not always separated one by one. For example, in some case, a stapled sheet bundle, a pasted and bound sheet bundle, or the like is inserted.

If such a sheet bundle is conveyed, not only a jam occurs but also the erasing apparatus is damaged.

Concerning this problem, there is proposed a technique for setting a double feed sensor and a thickness sensor in a recording medium conveying path and, if plural recording media are simultaneously conveyed, discarding the recording media in a disposal box.

However, if a sheet bundle having thickness equal to or larger than a measurement tolerance of the thickness sensor is conveyed, not only a jam occurs but also the thickness sensor is damaged.

Therefore, there is a demand for a recording medium removing apparatus that can remove a sheet bundle having thickness exceeding the tolerance of the thickness sensor without damaging the thickness sensor when the sheet bundle is conveyed thereto, an erasing apparatus and an automatic document feeding apparatus including the recording medium removing apparatus, and a recording medium removing method for use in the recording medium removing apparatus.

DETAILED DESCRIPTION

Throughout this description, the embodiments and examples shown should be considered exemplars, rather than limitations on the apparatus and methods of the present embodiments.

Exemplary embodiments of an erasing apparatus and an automatic document feeding apparatus including the recording medium removing apparatus, and a recording medium removing method for use in the recording medium removing apparatus of the present invention are explained in detail below with reference to the accompanying drawings.

In general, according to one embodiment, a recording medium removing apparatus includes: a first thickness sensor configured to change an output signal if the thickness of a recording medium is equal to or larger than a first threshold; a conveyance guide provided downstream in a recording medium conveying direction of the first thickness sensor and forming a conveying path for the recording medium; and a conveyance guide displacing device configured to displace the conveyance guide to expand the recording medium conveying path.

According to another embodiment, an erasing apparatus includes: a recording medium conveying mechanism configured to convey a recording medium; a first thickness sensor configured to change an output signal if the thickness of the recording medium is equal to or larger than a first threshold; a conveyance guide provided downstream in a recording medium conveying direction of the first thickness sensor and forming a conveying path for the recording medium; a conveyance guide displacing device configured to displace the conveyance guide to expand the recording medium conveying path; and a heating roller configured to heat the recording medium to temperature equal to or higher than erasing temperature.

According to still another embodiment, an automatic document feeding apparatus includes: a document tray on which an original document is placed; a pickup roller configured to pick up the original document from the document tray; a document feeding roller of a conveying mechanism configured to convey the original document; a first thickness sensor configured to change an output signal if the thickness of the original document is equal to or larger than a first threshold; a conveyance guide provided downstream in a document conveying direction of the first thickness sensor and forming a document conveying path; a conveyance guide displacing device configured to displace the conveyance guide to expand the document conveying path; a document reading section configured to cause the original document to pass to a scan position; a document reversing mechanism configured to reverse the front and the back of the original document; and a paper discharge tray onto which the original document is discharged and stacked.

First Embodiment

Figure 1:
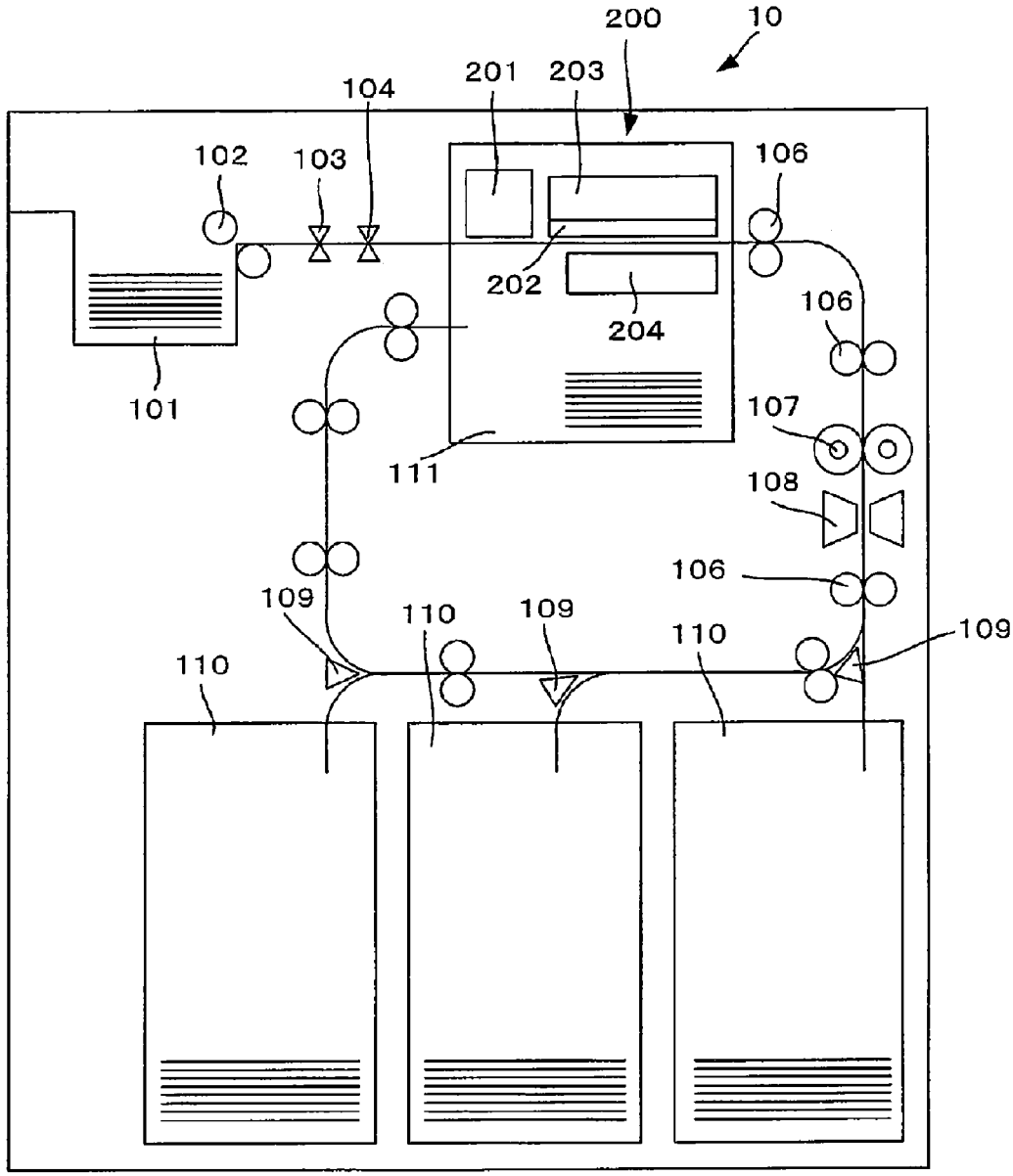
FIG. 1 is a side view of an erasing apparatus including a recording medium removing apparatus.

FIG. 1 is a side view of an erasing apparatus 10 including a recording medium removing apparatus 200. As shown in FIG. 1, the erasing apparatus 10 includes an inlet tray 101 on which recording media to be subjected to erasing are placed, a pickup roller 102 configured to pick up the recording media placed on the inlet tray 101 one by one, a passage sensor 103 configured to detect passage of the recording medium, a double feed sensor 104 configured to detect double feed of the recording media, conveying rollers 106 configured to convey the recording medium, the recording medium removing apparatus 200 configured to remove, from a recording medium conveying path, the recording medium determined as unconveyable, a heating roller 107, as the heating device, configured to heat the recording medium to temperature equal to or higher than erasing temperature, an image detection sensor 108 configured to detect whether an image on the recording medium is erased, switching devices 109 configured to switch a conveying path for the recording medium, reuse boxes 110 in which reusable recording media are accumulated, a disposal box 111 in which unreusable recording media are accumulated, and a control unit.

The double feed sensor 104 causes, for example, ultrasound to pass from one surface to the other surface of the recording medium and outputs a level of the ultrasound passed through the recording medium. The control unit determines double feed on the basis of the level.

The heating roller 107, as the heating device, is formed of metal and includes a heater on the inside thereof. The heating roller 107 heats an erasable developing material on the recording medium to temperature equal to or higher than the erasing temperature and subjects the recording medium to erasing.

Any heat source may be used for the heating device as long as the devices can heat the recording media to the color erasing temperature or higher. For the heating devices, for example, thermal heads, halogen heaters, graphite heaters, IH (Induction Heater), rollers formed by heat conducting materials with heat generating lamps inside, or the like may be employed.

Any heat source which heats the recording media without contacting also may be employed for the heating device.

Examples of the erasable developing material include a color-assuming compound, a developer, and a decolorizer. Examples of the color-assuming compound include a leuco dye. Examples of the developer include phenol. Examples of the decolorizer include a substance that, when heated, dissolves with the color-assuming compound and does not have affinity with the developer.

The erasable developing material develops a color according to a mutual action of the color-assuming compound and the developer. Since the mutual action of the color-assuming compound and the developer is interrupted by heating to temperature equal to or higher than the erasing temperature, the developing material is erased.

The recording medium is determined as unreusable if an un-erased image is present on the recording medium. The recording medium is conveyed through the recording medium conveying path switched by the switching devices 109 and accumulated in the disposal box 111.

The recording medium removing apparatus 200 includes a thickness determining device 201 configured to determine whether the thickness of a recording medium is equal to or larger than a first threshold, a conveyance guide 202 forming a conveying path for the recording medium, conveyance guide displacing devices 203 configured to lift and lower the conveyance guide 202, and a removing mechanism 204 configured to remove, from the recording medium conveying path, the recording medium determined as unconveyable.

The recording medium removing apparatus 200 is set upstream in the recording medium conveying direction of the heating roller 107. The recording medium removing apparatus 200 is set further upstream in the recording medium conveying direction than a first curved portion of the recording medium conveying path.

The recording medium removing apparatus 200 includes the thickness determining device 201 further upstream in the recording medium conveying direction than the conveyance guide 202.

The recording medium removing apparatus 200 includes the removing mechanism 204 below the conveyance guide 202 across the recording medium conveying path.

The recording medium removing apparatus 200 includes the disposal box 111 below the removing mechanism 204.

Figure 2:
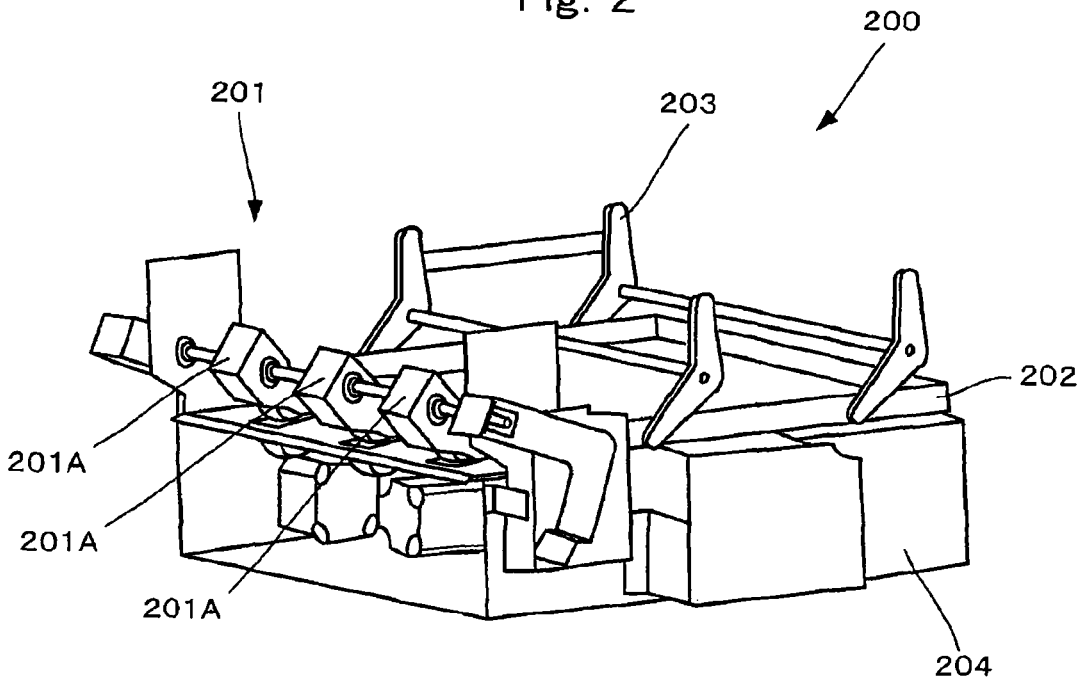
FIG. 2 is a perspective view of a recording medium conveying section of the recording medium removing apparatus.

FIG. 2 is a perspective view of a recording medium conveying section of the recording medium removing apparatus 200. In FIG. 2, a state in which the conveyance guide 202 is lowered is shown. As shown in FIG. 2, the conveyance guide 202 is formed in a plate shape. The conveyance guide displacing devices 203 support the conveyance guide 202 to be capable of being lifted and lowered. The recording medium removing apparatus 200 includes, in the recording medium conveying path, plural thickness detecting mechanisms 201A configured to detect the thickness of the recording medium.

Figure 3:
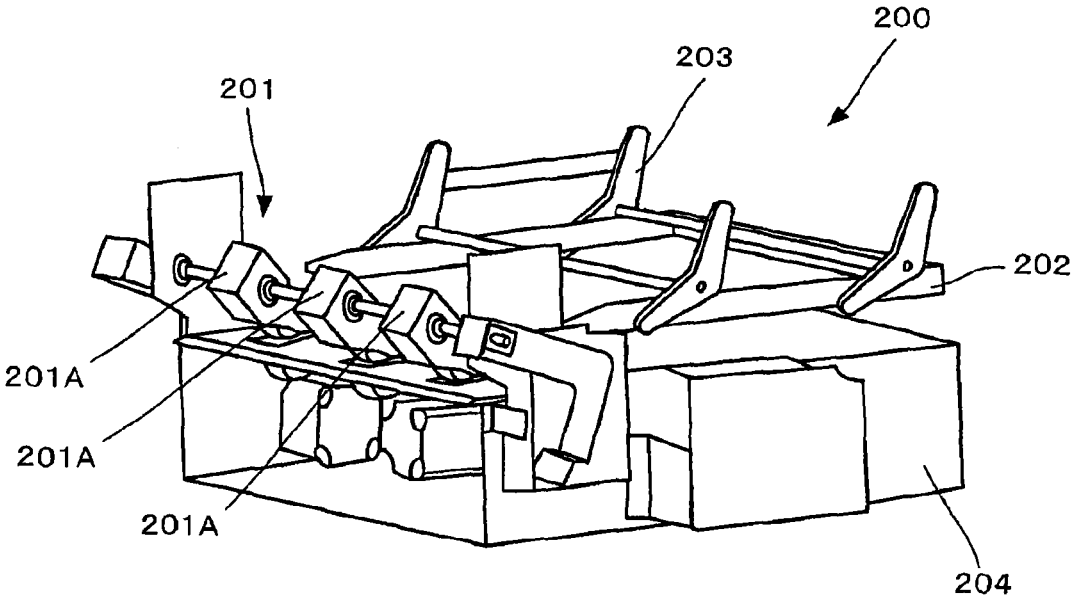
FIG. 3 is a diagram of a state in which the recording medium removing apparatus lifts a conveyance guide.

FIG. 3 is a diagram of a state in which the recording medium removing apparatus 200 lifts the conveyance guide 202. As shown in FIG. 3, if the erasing apparatus 10 determines, with the thickness determining device 201, that the thickness of the recording medium is equal to or smaller than the first threshold, the erasing apparatus 10 displaces the conveyance guide 202 to be lifted and expands the recording medium conveying path.

Figure 4:
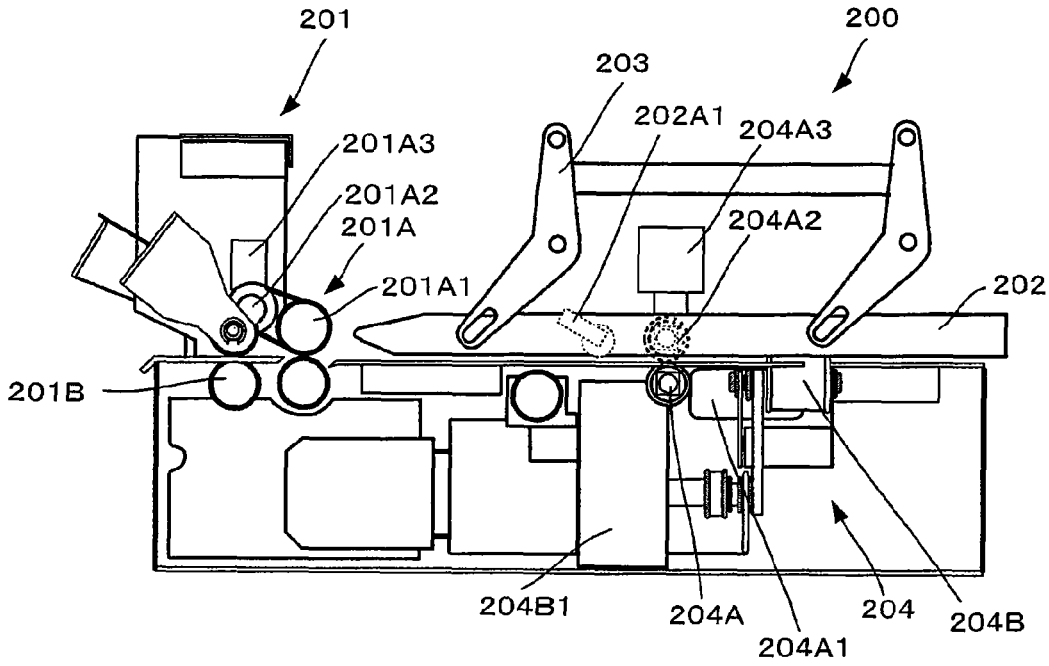
FIG. 4 is a side view of the recording medium removing apparatus.

FIG. 4 is a side view of the recording medium removing apparatus 200. In FIG. 4, a state in which the conveyance guide 202 is lowered is shown. As shown in FIG. 4, the thickness determining device 201 includes an inserting roller 201B configured to insert the recording medium into the thickness determining device 201, a detection roller 201A1 configured to move up and down according to the thickness of the recording medium, an actuator 201A2 configured to pivotably support the detection roller 201A1, and a first thickness sensor 201A3 configured to change an output signal from OFF to ON if the thickness of the recording medium is equal to or larger than the first threshold according to the rotation of the actuator 201A2.

The conveyance guide 202 includes, on the recording medium conveying path side, a second thickness sensor 202A1 configured to detect the thickness of the recording medium.

The second thickness sensor 202A1 brings an actuator into contact with the recording medium, transmits the movement of the actuator to a permanent magnet, detects the movement of the permanent magnet with a magnetic sensor, and outputs a signal corresponding to the thickness of the recording medium. The control unit determines the thickness of the recording medium on the basis of the output signal.

The second thickness sensor 202A1 is lifted and lowered according to lifting and lowering of the conveyance guide 202. The erasing apparatus 10 determines, with the second thickness sensor 202A1, whether the recording medium has thickness equal to or larger than a second threshold smaller than the first threshold.

The removing mechanism 204 includes conveyance driving rollers 204A configured to convey the recording medium in the recording medium conveying direction, conveying rollers 204A2 configured to rotate following the conveyance driving rollers 204A, a conveying roller solenoid 204A3 configured to lift and lower the conveying rollers 204A2, and a conveying motor 204A1 configured to drive the conveyance driving rollers 204A.

The removing mechanism 204 further includes, on a side at a right end or a left end with respect to the recording medium conveying direction, a pair of discharge rollers 204B having rotation axes in parallel to the recording medium conveying direction and a discharge motor 204B1 configured to drive the discharge rollers 204B.

Figure 5:
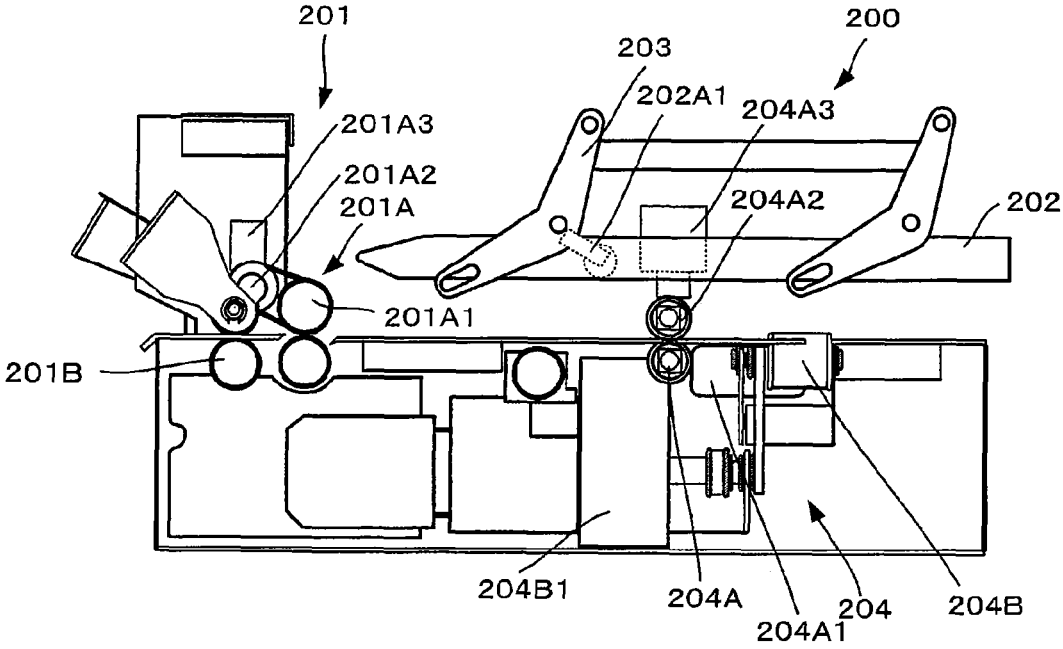
FIG. 5 is a side view of the recording medium removing apparatus that lifts the conveyance guide.

FIG. 5 is a side view of the recording medium removing apparatus 200 that lifts the conveyance guide 202. As shown in FIG. 5, if the erasing apparatus 10 determines, with the thickness determining device 201, that the thickness of the recording medium is equal to or larger than the first threshold, the erasing apparatus 10 lifts the conveyance guide 202 together with the second thickness sensor 202A1 and expands the recording medium conveying path.

Figure 6:
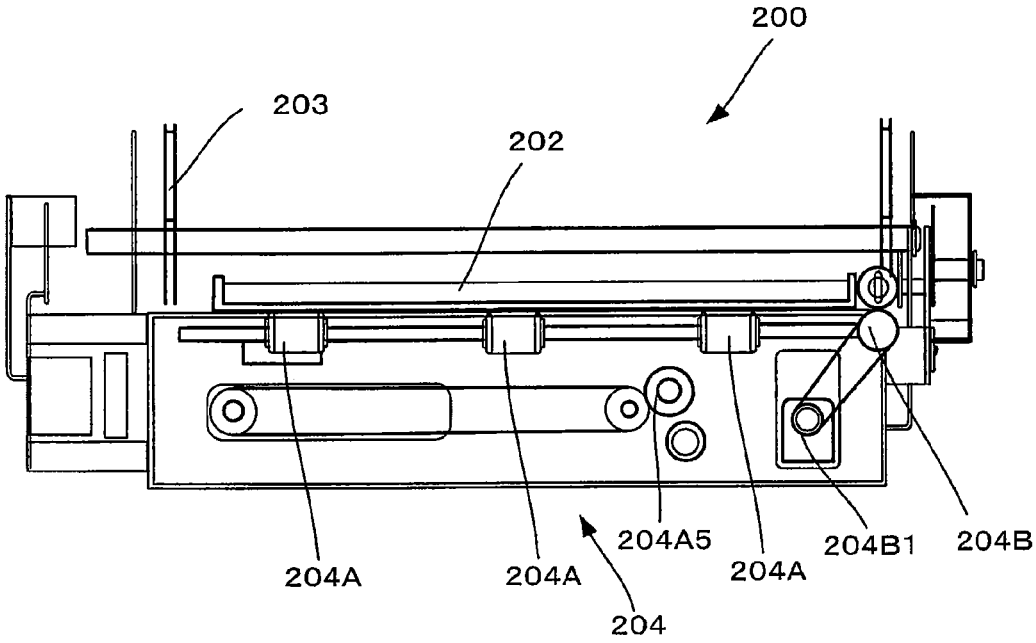
FIG. 6 is a front view of the recording medium removing apparatus viewed from upstream in a recording medium conveying direction.
Figure 7:
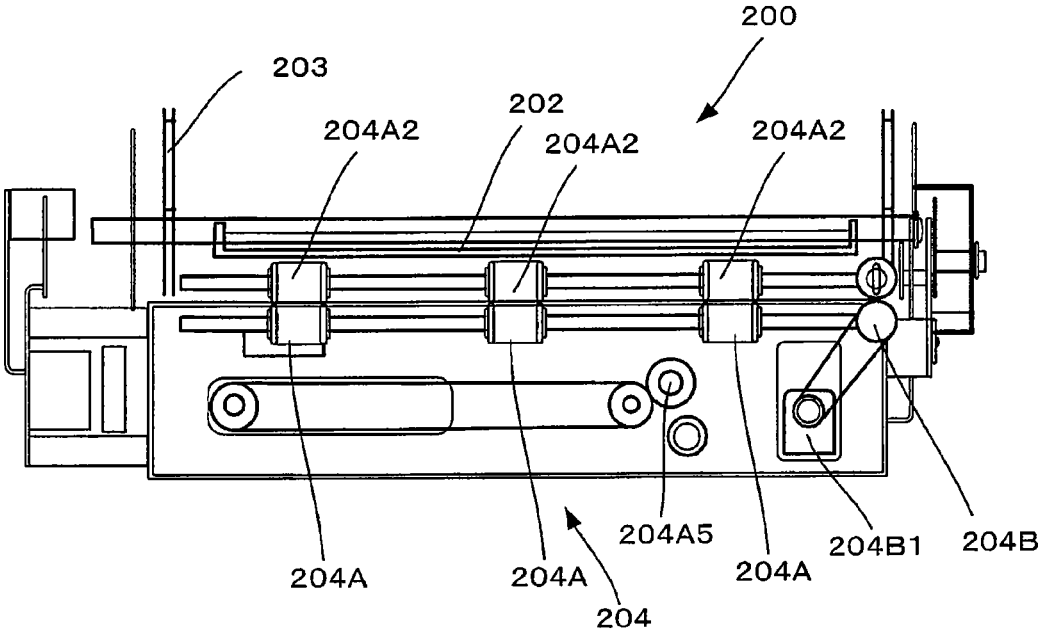
FIG. 7 is a front view of a state in which the recording medium removing apparatus lifts the conveyance guide.

FIG. 6 is a front view of the recording medium removing apparatus 200 viewed from upstream in the recording medium conveying direction. FIG. 7 is a front view of a state in which the recording medium removing apparatus 200 lifts the conveyance guide 202.

As shown in FIG. 6 and FIG. 7, the removing mechanism 204 includes a clutch 204A5 configured to move, when connected, the conveyance driving rollers 204A and the conveying rollers 204A2 to the discharge rollers 204B side in a direction perpendicular to the recording medium conveying direction and a vertical moving mechanism 204A4.

If the erasing apparatus 10 determines, with the thickness determining device 201, that the thickness of the recording medium is equal to or larger than the first threshold, first, the erasing apparatus 10 lifts the conveyance guide 202 together with the second thickness sensor 202A1. At this point, the conveyance driving rollers 204A and the conveying rollers 204A2 keep nipping the recording medium.

Subsequently, the erasing apparatus 10 turns on, i.e., connects the clutch 204A5 to drive the discharge motor 204B1. The vertical moving mechanism 204A4 moves the conveyance driving rollers 204A and the conveying rollers 204A2 to the discharge rollers 204B side in the direction perpendicular to the recording medium conveying direction. Therefore, the side ends of the recording medium reach the discharge rollers 204B.

If the erasing apparatus 10 detects, with a paper discharge sensor 807 set beside the discharge rollers 204B, that the side ends of the recording medium reach the discharge rollers 204B, the erasing apparatus 10 turns off, i.e., releases the clutch 204A5, lifts the conveying rollers 204A2 with the conveying roller solenoid 204A3, and releases the recording medium.

The discharge rollers 204B discharge the released recording medium to the disposal box 111.

Figure 8:
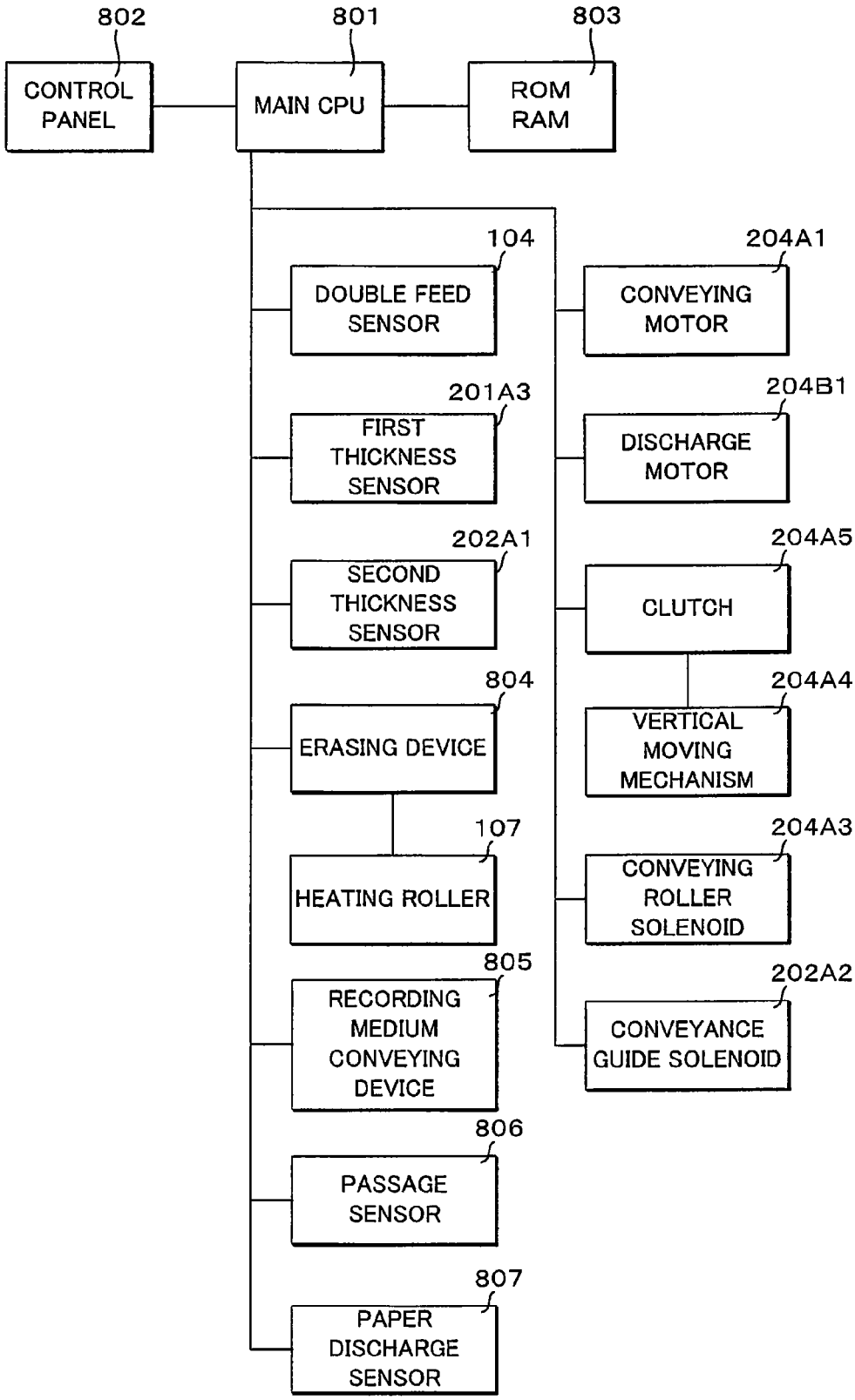
FIG. 8 is a block diagram of the configuration of an erasing apparatus.

FIG. 8 is a block diagram of the configuration of the erasing apparatus 10. As shown in FIG. 8, the erasing apparatus 10 includes a main CPU 801 serving as a control unit, a control panel 802 serving as a display device, and a ROM and RAM 803 serving as a storage device.

The main CPU 801 is connected to the double feed sensor 104, the first thickness sensor 201A3, the second thickness sensor 202A1, a passage sensor 806 provided at a lower end of the recording medium conveying path of the removing mechanism 204 and configured to detect that the recording medium reaches a dischargeable position, and the paper discharge sensor 807, all of which are included in the erasing apparatus 10. The main CPU 801 receives outputs of these sensors.

The main CPU 801 is connected to an erasing device 804 configured to drive the heating roller 107, a recording medium conveying device 805, the conveying motor 204A1, the discharge motor 204B1, the clutch 204A5, the conveying roller solenoid 204A3, and a conveyance guide solenoids 202A2 configured to drive the conveyance guide displacing devices 203 and lift and lower the conveyance guide 202. The main CPU 801 controls the operations of these devices.

Figure 9:
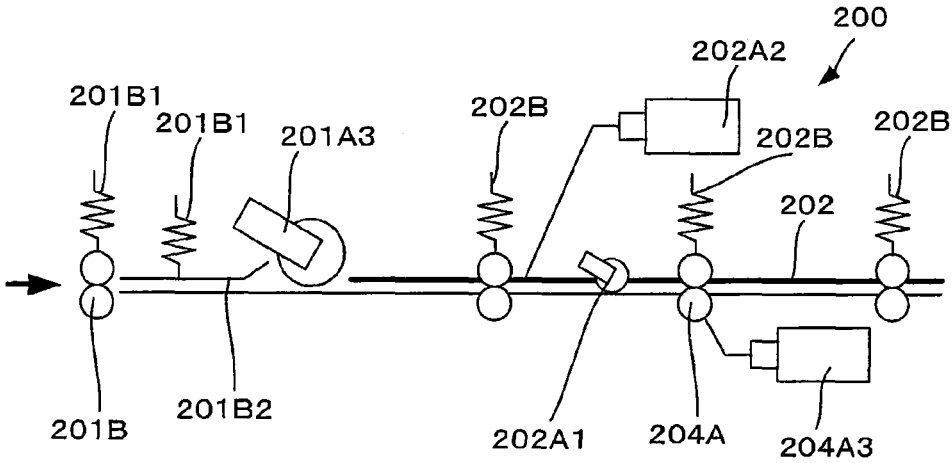
FIG. 9 is a schematic diagram of the recording medium removing apparatus.
Figure 10:
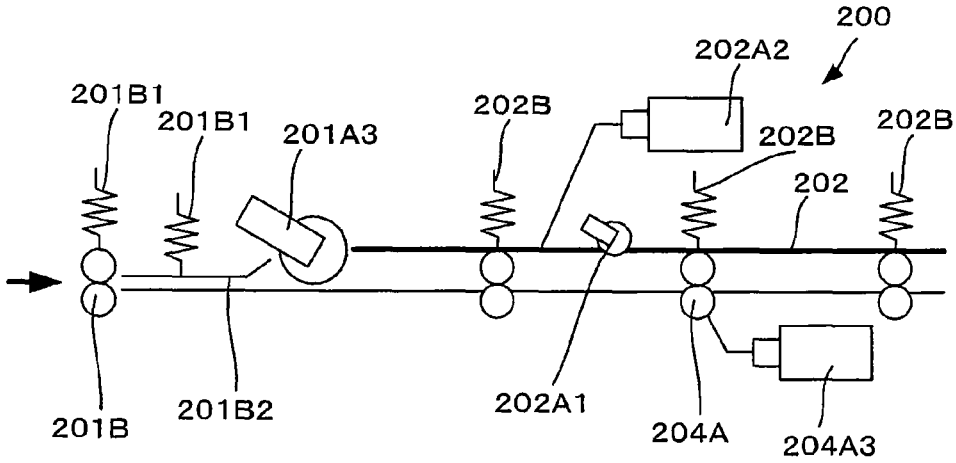
FIG. 10 is a schematic diagram of a state in which the recording medium removing apparatus lifts the conveyance guide.

FIG. 9 is a schematic diagram of the recording medium removing apparatus 200. FIG. 10 is a schematic diagram of a state in which the recording medium removing apparatus 200 lifts the conveyance guide 202.

As shown in FIG. 9 and FIG. 10, the inserting roller 201B and an insertion guide 201B2 forming the recording medium conveying path of the thickness determining device 201 are locked by elastic members 201B1 to be displaceable up and down. The conveyance guide 202 is locked by elastic members 202B to be displaceable up and down.

Figure 11:
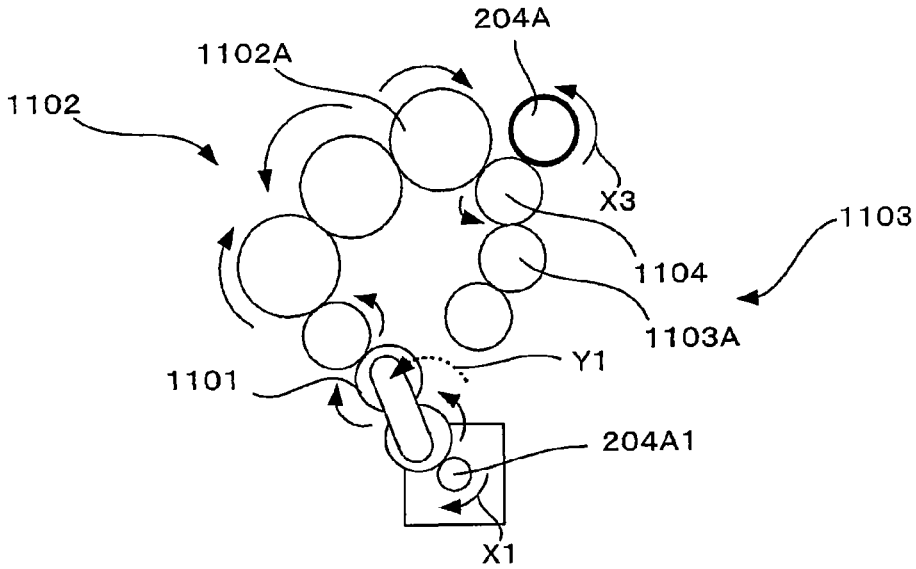
FIG. 11 is a diagram of a speed changing mechanism for conveying rollers.
Figure 12:
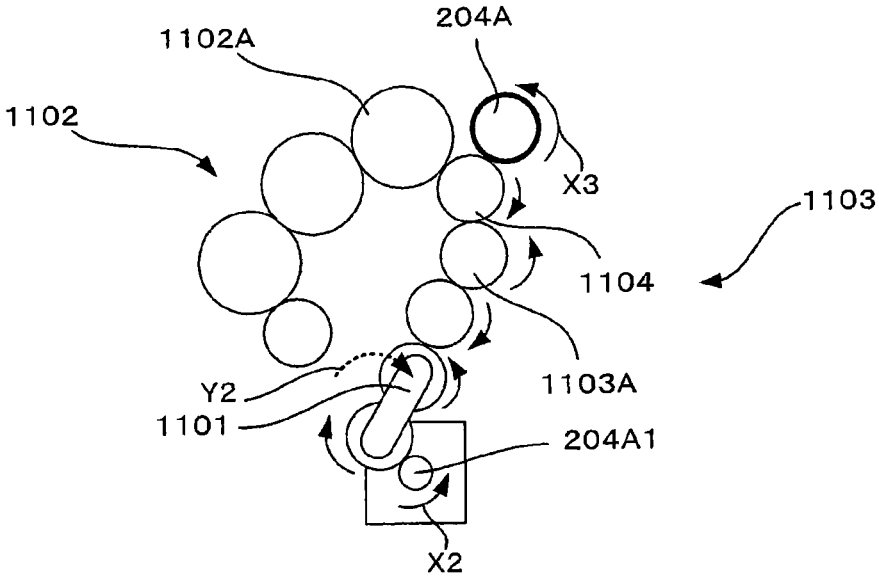
FIG. 12 is a diagram of the speed changing mechanism for the conveying rollers.

FIG. 11 and FIG. 12 are diagrams of a speed changing mechanism for the conveyance driving roller 204A. If the erasing apparatus 10 determines that the thickness of the recording medium is equal to or larger than the first threshold or the second threshold, the erasing apparatus 10 changes conveying speed for the recording medium.

Specifically, the erasing apparatus 10 changes the conveying speed such that conveying speed of a recording medium determined as conveyable exceeds conveying speed of the recording medium determined as unconveyable. If the erasing apparatus 10 determines that the recording medium is unconveyable, the erasing apparatus 10 reduces the conveying speed for the recording medium. Alternatively, if the erasing apparatus 10 determines that the recording medium is conveyable, the erasing apparatus 10 increases the conveying speed for the recording medium. If the conveying speed falls, conveying torque increases and even a thick recording medium can be conveyed.

When a stepping motor is used for the conveying motor 204A1 as a speed changing mechanism, the erasing apparatus 10 reduces pulse width of a stepping pulse to increase the conveying speed and increases the pulse width to reduce the conveying speed.

The erasing apparatus 10 can also use the speed changing mechanism. As shown in FIGS. 11 and 12, the speed changing mechanism includes a first gear train 1102 including a planetary gear 1101 driven by the conveying motor 204A1 and plural gears driven by the planetary gear 1101, a second gear train 1103 including gears smaller in number than the number of gears of the first gear train 1102 by two or more and including the number of teeth of the gears smaller than the number of teeth of the gears of the first gear train 1102, a last gear 1102A of the first gear train 1102, a last gear 1103A of the second gear train 1103, and a last driven gear 1104 connected to the conveyance driving roller 204A.

As shown in FIG. 11, if the conveying motor 204A1 regularly rotates in a direction of an arrow X1, the planetary gear 1101 falls down to the first gear train 1102 side to drive the first gear train 1102.

As shown in FIG. 12, if the conveying motor 204A1 reversely rotates in a direction of an arrow X2, the planetary gear 1101 falls down to the second gear train 1103 side to drive the second gear train 1103.

The number of teeth of the gears of the second gear train 1103 is smaller than the number of teeth of the gears of the first gear train 1102. The number of gears of the first gear train 1102 is larger than the number of gears of the second gear train 1103 by two or more. Therefore, if the conveying motor 204A1 regularly rotates in the direction of the arrow X1, the conveyance driving roller 204A rotates in a direction of an arrow X3 at low speed and high torque. If the conveying motor 204A1 reversely rotates in the direction of the arrow X2, the conveyance driving roller 204A rotates in the direction of the arrow X3 at high speed and low torque.

Figure 13:
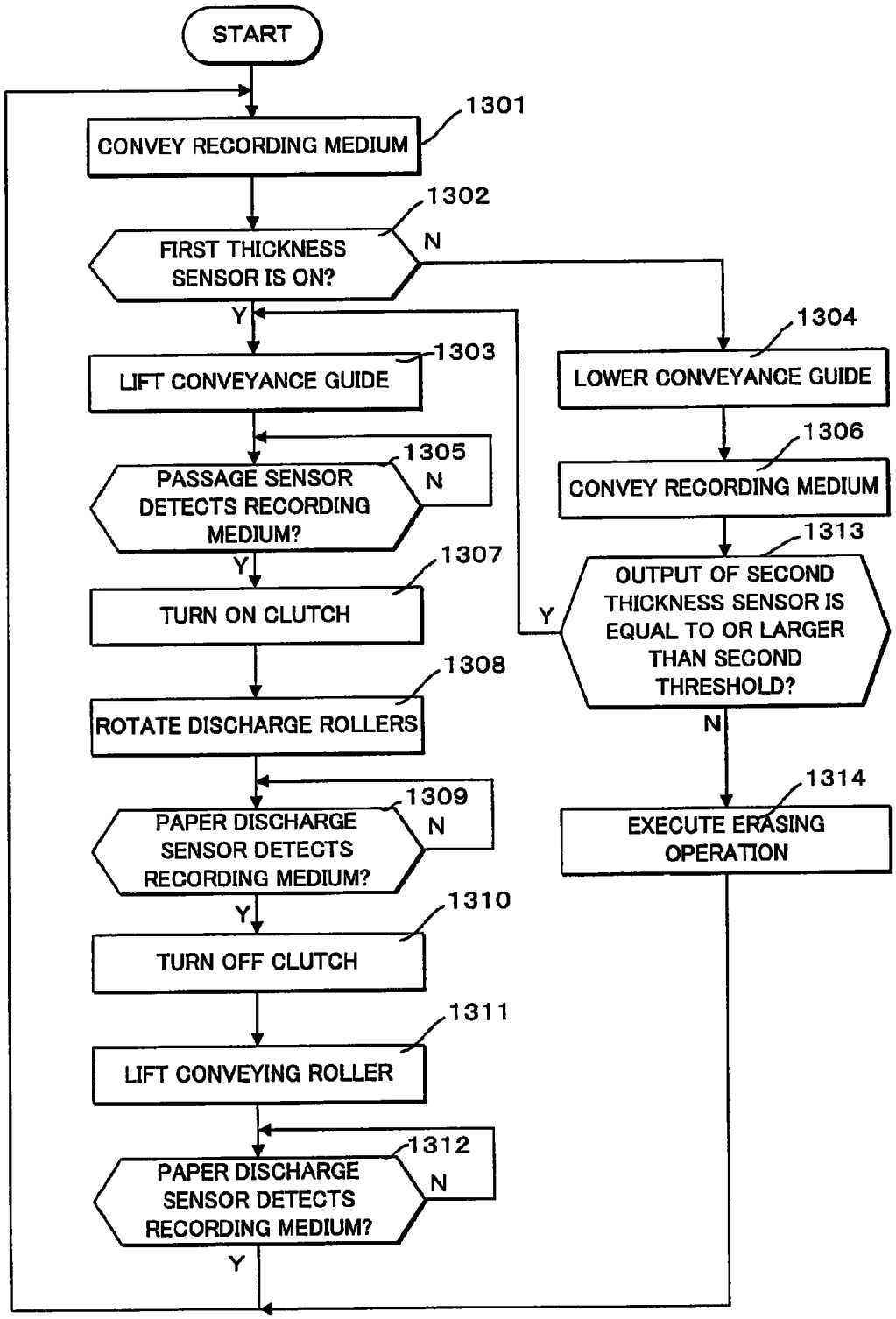
FIG. 13 is a flowchart for explaining the operation of the erasing apparatus.

FIG. 13 is a flowchart for explaining the operation of the erasing apparatus 10. As shown in FIG. 13, in Act 1301, the erasing apparatus 10 conveys a recording medium and inserts the recording medium into the recording medium removing apparatus 200.

In Act 1302, the erasing apparatus 10 determines whether the first thickness sensor 201A3 is turned on. If the erasing apparatus 10 determines that the first thickness sensor 201A3 is turned on, the erasing apparatus 10 proceeds to Act 1303. If the erasing apparatus 10 determines that the first thickness sensor 201A3 is not turned on, the erasing apparatus 10 proceeds to Act 1304.

In Act 1303, the erasing apparatus 10 lifts the conveyance guide 202.

In Act 1305, the erasing apparatus 10 determines whether the passage sensor 806 detects the recording medium. If the erasing apparatus 10 determines that the passage sensor 806 detects the recording medium, the erasing apparatus 10 proceeds to Act 1307. If the erasing apparatus 10 determines that the passage sensor 806 does not detect the recording medium, the erasing apparatus 10 returns to Act 1305.

In Act 1307, the erasing apparatus 10 turns on the clutch 204A5 and moves, with the vertical moving mechanism 204A4, the recording medium nipped by the conveyance driving rollers 204A and the conveying rollers 204A2 to the discharge rollers 204B side in the direction perpendicular to the recording medium conveying direction.

In Act 1308, the erasing apparatus 10 rotates the discharge rollers 204B.

In Act 1309, the erasing apparatus 10 determines whether the paper discharge sensor 807 detects the recording medium. If the erasing apparatus 10 determines that the paper discharge sensor 807 detects the recording medium, the erasing apparatus 10 proceeds to Act 1310. If the erasing apparatus 10 determines that the paper discharge sensor 807 does not detect the recording medium, the erasing apparatus 10 returns to Act 1309.

In Act 1310, the erasing apparatus 10 turns off the clutch 204A5.

In Act 1311, the erasing apparatus 10 lifts the conveying rollers 204A2. Therefore, the recording medium is discharged to the disposal box 111 by the discharge rollers 204B.

In Act 1312, the erasing apparatus 10 determines whether the paper discharge sensor 807 detects the recording medium. If the erasing apparatus 10 determines that the paper discharge sensor 807 detects the recording medium, the erasing apparatus 10 returns Act 1301. If the erasing apparatus 10 determines that the paper discharge sensor 807 does not detect the recording medium, the erasing apparatus 10 returns to Act 1312.

In Act 1304, the erasing apparatus 10 lowers the conveyance guide 202. In Act 1306, the erasing apparatus 10 conveys the recording medium.

In Act 1313, the erasing apparatus 10 determines, on the basis of an output of the second thickness sensor 202A1, whether the thickness of the recording medium is equal to or larger than the second threshold. If the erasing apparatus 10 determines that the thickness of the recording medium is equal to or larger than the second threshold, the erasing apparatus 10 proceeds to Act 1303. If the erasing apparatus 10 determines that the thickness of the recording medium is not equal to or larger than the second threshold, the erasing apparatus 10 proceeds to Act 1314.

In Act 1314, the erasing apparatus 10 executes an erasing operation on the recording medium.

As explained above, the erasing apparatus 10 including the recording medium removing apparatus 200 according to this embodiment includes the thickness determining device 201 configured to determine whether the thickness of the recording medium is equal to or larger than the first threshold, the conveyance guide 202 forming the conveying path for the recording medium, the conveyance guide displacing devices 203 configured to lift the conveyance guide 202 if the thickness determining device 201 determines that the thickness of the recording medium is equal to or larger than the first threshold, and the removing mechanism 204 configured to remove, from the recording medium conveying path, the recording medium determined as unconveyable.

Therefore, there is an effect that, even if a sheet bundle having thickness exceeding a tolerance of the thickness sensor is conveyed to the erasing apparatus 10, it is possible to remove the sheet bundle without damaging the thickness sensor.

Second Embodiment

Figure 14:
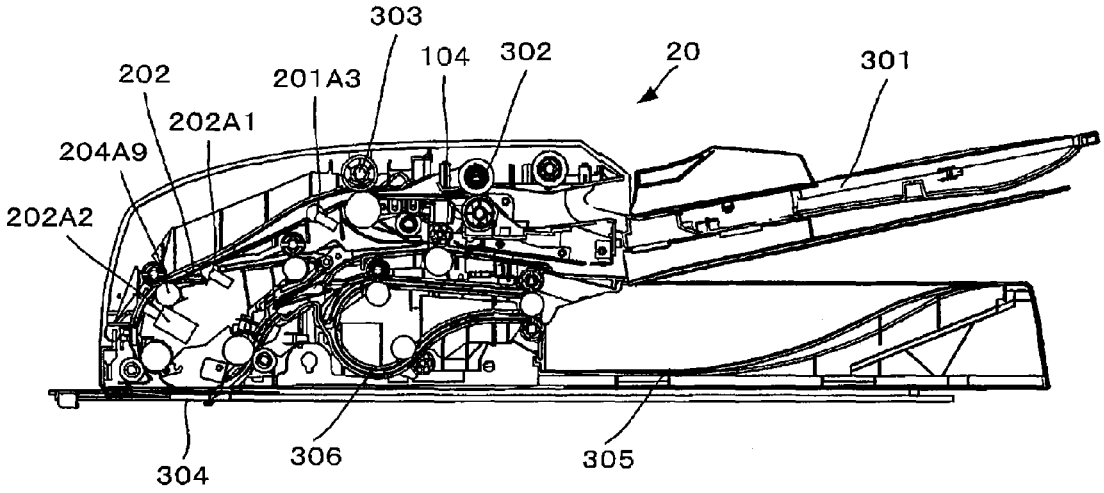
FIG. 14 is a side view of an automatic document feeding apparatus including the recording medium removing apparatus.

FIG. 14 is a side view of an automatic document feeding apparatus 20 including the recording medium removing apparatus 200. As shown in FIG. 14, the automatic document feeding apparatus 20 includes a document tray 301 on which original documents are placed, a pickup roller 302 configured to pick up the original documents from the document tray 301 one by one, a double feed sensor 104, a document feeding roller 303 of a conveying mechanism configured to convey the original document, the first thickness sensor 201A3, the conveyance guide 202 provided downstream in the recording medium conveying direction of the first thickness sensor 201A3, the conveyance guide solenoid 202A2 configured to displace the conveyance guide 202 in an inner direction to expand the recording medium conveying path, the second thickness sensor 202A1 configured to be displaced together with the conveyance guide 202, a conveying roller 204A9 configured to convey the recording medium, a document reading section 304 formed of a cutout section or a transparent material and configured to cause the original document to pass to a scan position, a document reversing mechanism 306 configured to reverse the front and the back of the original document, and a paper discharge tray 305 onto which the original document is discharged and stacked.

The recording medium removing apparatus 200 includes the first thickness sensor 201A3, the conveyance guide 202, and the conveyance guide solenoid 202A2. The recording medium removing apparatus 200 is provided upstream in a document feeding direction of the document reading section 304.

Figure 15:
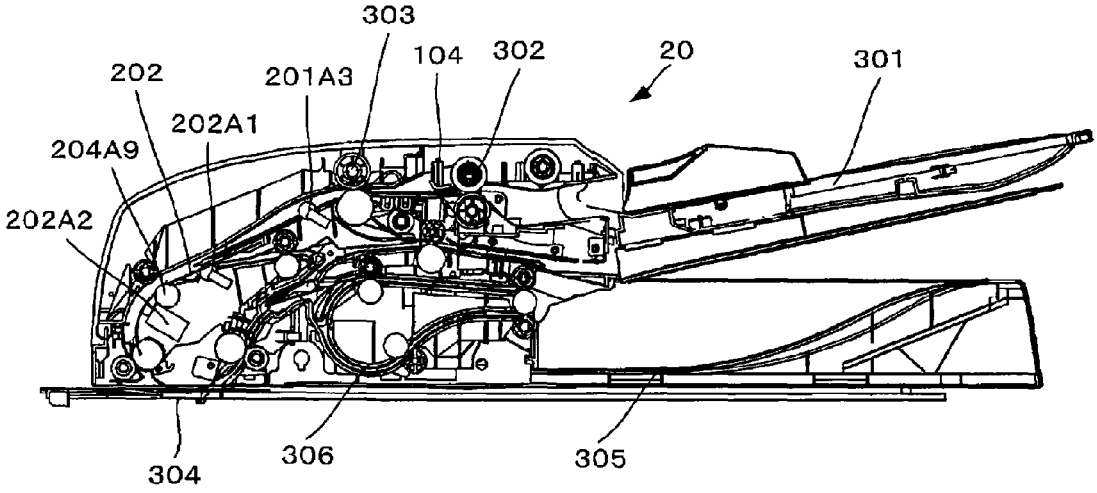
FIG. 15 is a diagram of a state in which the automatic document feeding apparatus displaces a conveyance guide.

FIG. 15 is a diagram of a state in which the automatic document feeding apparatus 20 displaces the conveyance guide 202.

As shown in FIG. 15, the automatic document feeding apparatus 20 picks up an original document with the pickup roller 302 and conveys the original document in the direction of the document reading section 304 with the document feeding roller 303. The automatic document feeding apparatus 20 reverses the front and the back of the original document, which passes the document reading section 304, with the document reversing mechanism 306 and causes the original document to pass the document reading section 304 again. The automatic document feeding apparatus 20 discharges the original document to the paper discharge tray 305.

If the automatic document feeding apparatus 20 determines, with the first thickness sensor 201A3, that the thickness of the original document is equal to or larger than the first threshold, the automatic document feeding apparatus 20 displaces the conveyance guide 202 to expand the recording medium conveying path.

The automatic document feeding apparatus 20 reversely rotates a conveying motor 204A8, which drives a conveying roller 204A9, and the document feeding roller 303 to discharge the original document to the document tray 301.

When the automatic document feeding apparatus 20 reversely rotates the conveying motor 204A8 and the document feeding roller 303, the automatic document feeding apparatus 20 changes conveying speed.

Specifically, the automatic document feeding apparatus 20 changes the conveying speed such that conveying speed of a recording medium determined as conveyable exceeds conveying speed of the recording medium determined as unconveyable. If the automatic document feeding apparatus 20 determines that the recording medium is unconveyable, the automatic document feeding apparatus 20 reduces the conveying speed for the recording medium. Alternatively, if the automatic document feeding apparatus 20 determines that the recording medium is conveyable, the automatic document feeding apparatus 20 increases the conveying speed for the recording medium. If the conveying speed falls, conveying torque increases and even a thick recording medium can be conveyed.

When a stepping motor is used for the conveying motor 204A8 as a speed changing mechanism, the automatic document feeding apparatus 20 reduces pulse width of a stepping pulse to increase the conveying speed and increases the pulse width to reduce the conveying speed.

The automatic document feeding apparatus 20 can also use the speed changing mechanism described in the first embodiment.

Figure 16:
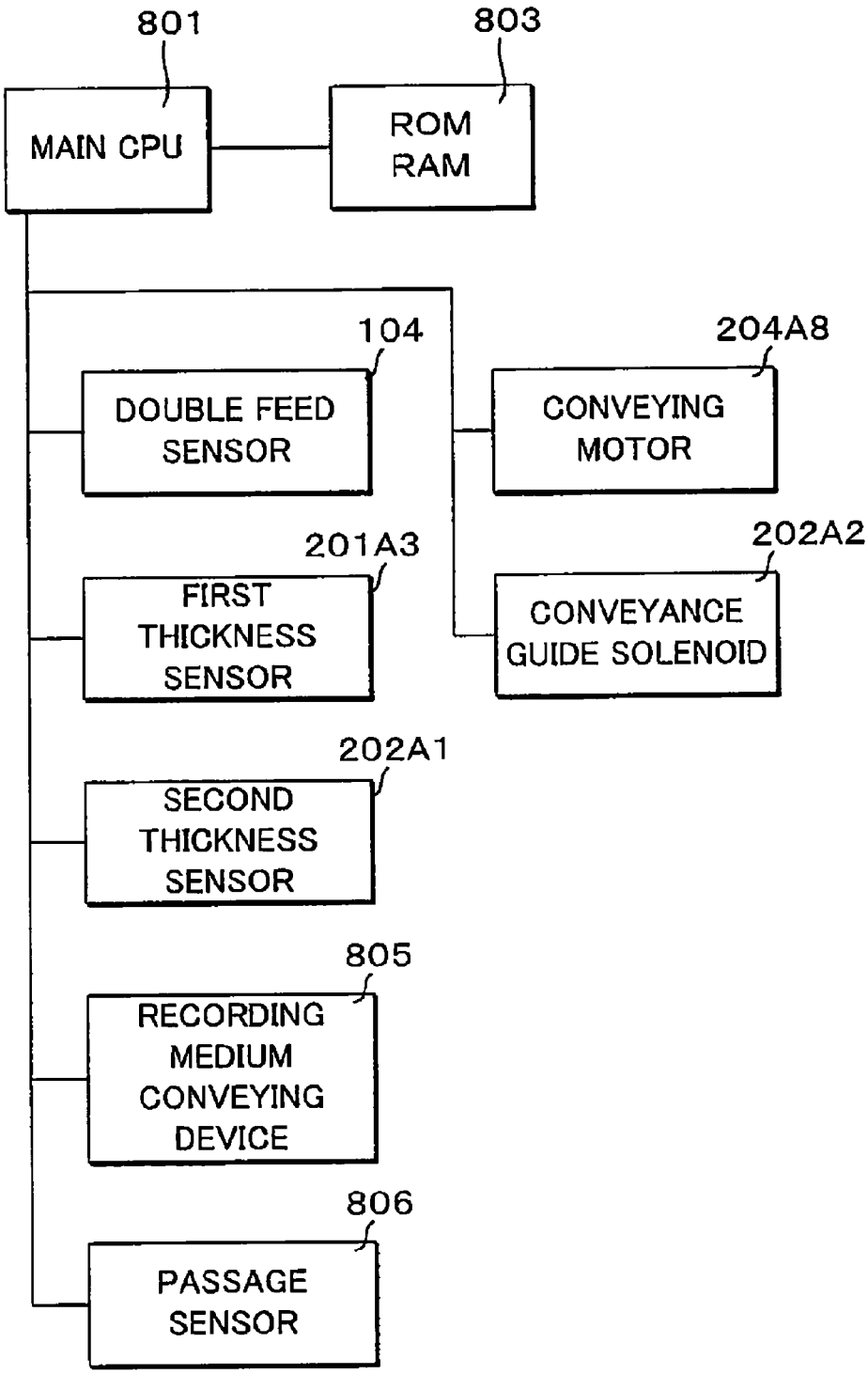
FIG. 16 is a block diagram of the configuration of the automatic document feeding apparatus.

FIG. 16 is a block diagram of the configuration of the automatic document feeding apparatus 20. As shown in FIG. 16, the automatic document feeding apparatus 20 includes the main CPU 801 serving as a control unit and the ROM and RAM 803 serving as a storage device.

The main CPU 801 is connected to the double feed sensor 104, the first thickness sensor 201A3, the second thickness sensor 202A1, and the passage sensor 806 provided in an inlet of a document conveying path, all of which are included in the automatic document feeding apparatus 20. The main CPU 801 receives outputs of these sensors.

The main CPU 801 is connected to the conveying motor 204A1 and the conveyance guide solenoids 202A2 configured to drive the conveyance guide displacing devices 203 and lift and lower the conveyance guide 202. The main CPU 801 controls the operations of these devices.

Figure 17:
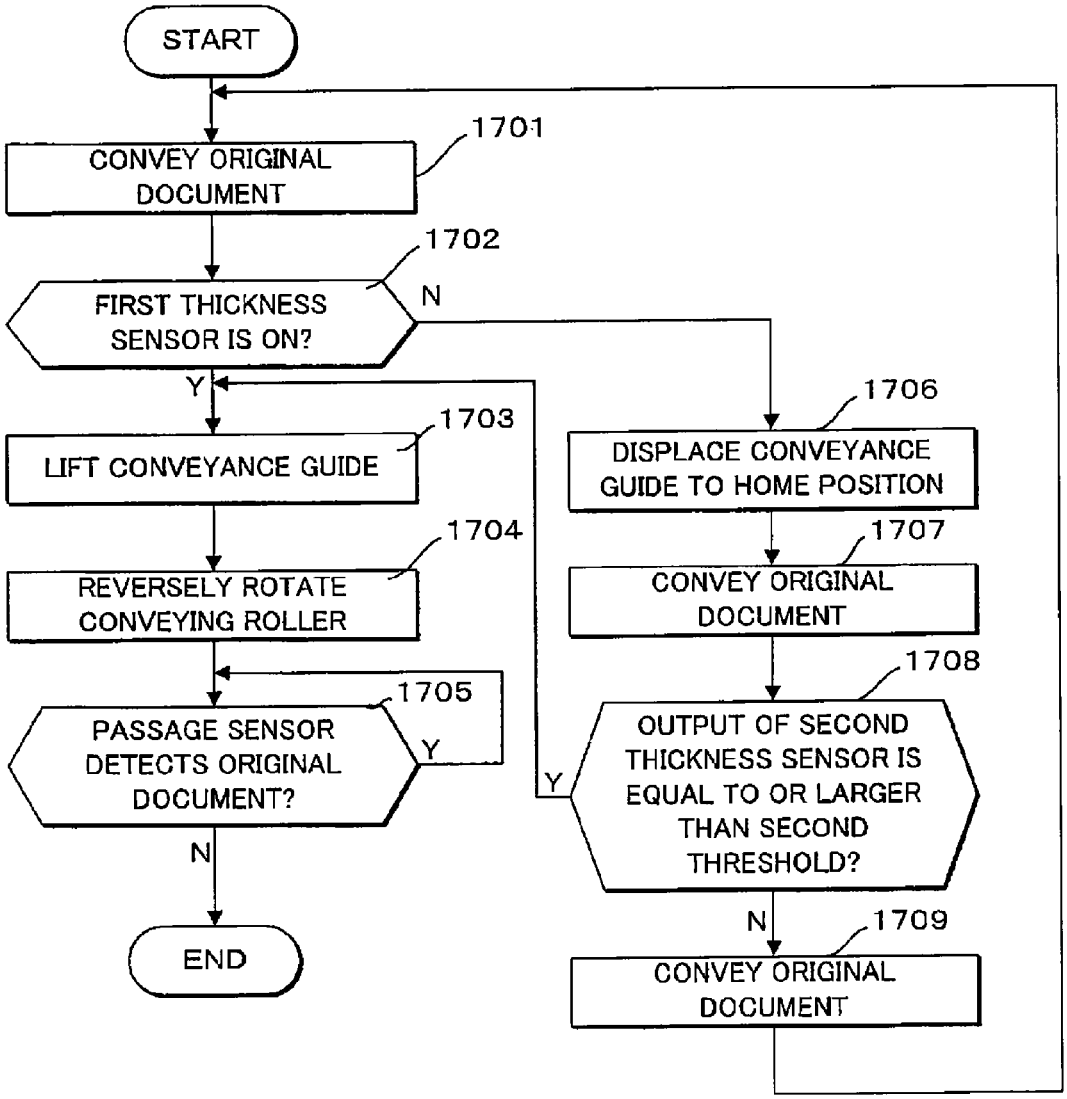
FIG. 17 is a diagram of the operation of the automatic document feeding apparatus.

FIG. 17 is a diagram of the operation of the automatic document feeding apparatus 20. As shown in FIG. 17, in Act 1701, the automatic document feeding apparatus 20 conveys an original document.

In Act 1702, the automatic document feeding apparatus 20 determines whether the first thickness sensor 201A3 is turned on. If the automatic document feeding apparatus 20 determines that the first thickness sensor 201A3 is turned on, the automatic document feeding apparatus 20 proceeds to Act 1703. If the automatic document feeding apparatus 20 determines that the first thickness sensor 201A3 is not turned on, the automatic document feeding apparatus 20 proceeds to Act 1706.

In Act 1703, the automatic document feeding apparatus 20 lifts the conveyance guide 202.

In Act 1704, the automatic document feeding apparatus 20 reversely rotates the conveying roller 204A9 and the document feeding roller 303.

In Act 1705, the automatic document feeding apparatus 20 determines whether the passage sensor 806 detects the recording medium. If the automatic document feeding apparatus 20 determines that the passage sensor 806 does not detect the recording medium, the automatic document feeding apparatus 20 ends the processing. If the automatic document feeding apparatus 20 determines that the passage sensor 806 detects the recording medium, the automatic document feeding apparatus 20 returns to Act 1705.

In Act 1706, the automatic document feeding apparatus 20 displaces the conveyance guide 202 to a home position.

In Act 1707, the automatic document feeding apparatus 20 conveys the original document.

In Act 1708, the automatic document feeding apparatus 20 determines, on the basis of an output of the second thickness sensor 202A1, whether the thickness of the recording medium is equal to or larger than the second threshold. If the automatic document feeding apparatus 20 determines that the thickness of the recording medium is equal to or larger than the second threshold, the automatic document feeding apparatus 20 proceeds to Act 1703. If the automatic document feeding apparatus 20 determines that the thickness of the recording medium is not equal to or larger than the second threshold, the automatic document feeding apparatus 20 proceeds to Act 1709.

In Act 1709, the automatic document feeding apparatus 20 conveys the original document to the document reading section 304 and returns to Act 1701.

As explained above, the automatic document feeding apparatus 20 including the recording medium removing apparatus 200 according to this embodiment includes the first thickness sensor 201A3 configured to detect the thickness of the original document, the conveyance guide 202 forming the conveying path for the original document, and the conveyance guide solenoid 202A2 configured to lift the conveyance guide 202 if the automatic document feeding apparatus 20 determines that the thickness of the original document is equal to or larger than the first threshold.

Therefore, there is an effect that, even if a sheet bundle having thickness exceeding a tolerance of the thickness sensor is conveyed to the automatic document feeding apparatus 20, it is possible to feed the sheet bundle backward and remove the sheet bundle without damaging the thickness sensor.

While certain embodiments have been described, these embodiments have been presented by way of example only, and are not intended to limit the scope of the inventions. Indeed, the novel methods and apparatuses described herein may be embodied in a variety of other forms; furthermore, various omissions, substitutions and changes in the form of the methods and systems described herein may be made without departing from the spirit of the inventions. The accompanying claims and their equivalents are indeed to cover such forms or modifications as would fall within the scope and spirit of the inventions.

What is claimed is:

1. A recording medium removing apparatus comprising:

a first thickness sensor configured to change an output signal if thickness of a recording medium is equal to or larger than a first threshold;

a conveyance guide provided downstream in a recording medium conveying direction of the first thickness sensor and forming a conveying path for the recording medium; and a conveyance guide displacing device configured to displace the conveyance guide to expand the recording medium conveying path.

2. The apparatus according to claim 1, further comprising an actuator configured to be displaced according to the thickness of the recording medium and change the output signal of the first thickness sensor if the thickness of the recording medium is equal to or larger than the first threshold.

3. The apparatus according to claim 1, further comprising a second thickness sensor provided downstream in the recording medium conveying direction of the first thickness sensor and configured to output a signal corresponding to the thickness of the recording medium.

4. The apparatus according to claim 3, wherein the second thickness sensor is displaced together with the conveyance guide.

5. The apparatus according to claim 1, further comprising a removing mechanism provided downstream in the recording medium conveying direction of the first thickness sensor and configured to remove, from the recording medium conveying path, the recording medium determined as unconveyable.

6. The apparatus according to claim 5, wherein the removing mechanism includes:

a conveyance driving roller configured to convey the recording medium in the recording medium conveying direction;

a conveying roller configured to rotate following the conveyance driving roller;

a conveying roller solenoid configured to lift and lower the conveying roller;

a conveying motor configured to drive the conveyance driving roller;

a pair of discharge rollers provided sideways with respect to the recording medium conveying direction and having rotation axes in parallel to the recording medium conveying direction; and a discharge motor configured to drive the discharge rollers.

7. The apparatus according to claim 6, wherein the removing mechanism conveys the recording medium determined as unconveyable to the discharge rollers while nipping the recording medium with the conveyance driving roller and the conveying roller, and the discharge rollers discharge the recording medium, which is released by the conveyance driving roller and the conveying roller, in a direction perpendicular to the recording medium conveying direction.

8. The apparatus according to claim 6, further comprising:

a second thickness sensor configured to output a signal corresponding to the thickness of the recording medium;

a speed changing mechanism configured to change recording medium conveying speed of the conveying roller; and a control unit configured to control the speed changing mechanism, wherein the control unit displaces the conveyance guide to expand the recording medium conveying path and reduces the recording medium conveying speed of the conveying roller if the control unit determines, on the basis of an output of at least one of the first thickness sensor and the second thickness sensor, that the recording medium is unconveyable.

9. An erasing apparatus comprising:

a recording medium conveying mechanism configured to convey a recording medium;

a first thickness sensor configured to change an output signal if the thickness of the recording medium is equal to or larger than a first threshold;

a conveyance guide provided downstream in a recording medium conveying direction of the first thickness sensor and forming a recording medium conveying path;

a conveyance guide displacing device configured to displace the conveyance guide to expand the recording medium conveying path; and a heating device configured to heat the recording medium to temperature equal to or higher than erasing temperature.

10. The apparatus according to claim 9, further comprising an actuator configured to be displaced according to the thickness of the recording medium and change the output signal of the first thickness sensor if the thickness of the recording medium is equal to or larger than the first threshold.

11. The apparatus according to claim 9, further comprising a second thickness sensor provided downstream in the recording medium conveying direction of the first thickness sensor and configured to output a signal corresponding to the thickness of the recording medium.

12. The apparatus according to claim 11, wherein the second thickness sensor is displaced together with the conveyance guide.

13. The apparatus according to claim 9, further comprising a removing mechanism provided downstream in the recording medium conveying direction of the first thickness sensor and configured to remove, from the recording medium conveying path, the recording medium determined as unconveyable.

14. The apparatus according to claim 13, wherein the removing mechanism includes:

a conveyance driving roller configured to convey the recording medium in the recording medium conveying direction;

a conveying roller configured to rotate following the conveyance driving roller;

a conveying roller solenoid configured to lift and lower the conveying roller;

a conveying motor configured to drive the conveyance driving roller;

a pair of discharge rollers provided sideways with respect to the recording medium conveying direction and having rotation axes in parallel to the recording medium conveying direction; and a discharge motor configured to drive the discharge rollers.

15. The apparatus according to claim 14, wherein the removing mechanism conveys the recording medium determined as unconveyable to the discharge rollers while nipping the recording medium with the conveyance driving roller and the conveying roller, and the discharge rollers discharge the recording medium, which is released by the conveyance driving roller and the conveying roller, in a direction perpendicular to the recording medium conveying direction.

16. The apparatus according to claim 14, further comprising:

a second thickness sensor provided downstream in the recording medium conveying direction of the first thickness sensor and configured to output a signal corresponding to the thickness of the recording medium;

a speed changing mechanism configured to change recording medium conveying speed of the conveying roller; and a control unit configured to control the speed changing mechanism, wherein the control unit displaces the conveyance guide to expand the recording medium conveying path and reduces the recording medium conveying speed of the conveying roller if the control unit determines, on the basis of an output of at least one of the first thickness sensor and the second thickness sensor, that the recording medium is unconveyable.

17. An automatic document feeding apparatus comprising:

a document tray on which an original document is placed;

a pickup roller configured to pick up the original document from the document tray;

a document feeding roller of a conveying mechanism configured to convey the original document;

a first thickness sensor configured to change an output signal if the thickness of the original document is equal to or larger than a first threshold;

a conveyance guide provided downstream in a document conveying direction of the first thickness sensor and forming a document conveying path;

a conveyance guide displacing device configured to displace the conveyance guide to expand the document conveying path;

a document reading section configured to cause the original document to pass to a scan position;

a document reversing mechanism configured to reverse a front and a back of the original document; and a paper discharge tray onto which the original document is discharged and stacked.

18. The apparatus according to claim 17, further comprising an actuator configured to be displaced according to the thickness of the recording medium and change the output signal of the first thickness sensor if the thickness of the recording medium is equal to or larger than the first threshold.

19. The apparatus according to claim 17, further comprising a second thickness sensor provided downstream in the recording medium conveying direction of the first thickness sensor and configured to output a signal corresponding to the thickness of the recording medium.

20. The apparatus according to claim 19, wherein the second thickness sensor is displaced together with the conveyance guide.

21. The apparatus according to claim 17, wherein the document feeding roller reversely rotates and discharges the original document if the original document is determined as unconveyable.

22. A recording medium removing method for a recording medium removing apparatus including a control unit, the method comprising:

displacing a conveyance guide forming a recording medium conveying path to expand the recording medium conveying path if a first thickness sensor determines that thickness of a recording medium is equal to or larger than a first threshold; and removing the recording medium.

23. The method according to claim 22, further comprising removing the recording medium if the first thickness sensor determines that the thickness of the recording medium is not equal to or larger than the first threshold and a second thickness sensor, which is displaced together with the conveyance guide, determines that the thickness of the recording medium is equal to or larger than a second threshold.

24. The method according to claim 22, further comprising:

conveying the recording medium determined as unconveyable to discharge rollers while nipping the recording medium with a conveyance driving roller and a conveying roller; and discharging, with the discharge rollers, the recording medium, which is released by the conveyance driving roller and the conveying roller, in a direction perpendicular to a recording medium conveying direction.

25. The method according to claim 22, further comprising feeding the recording medium determined as unconveyable backward and discharging the recording medium.

* * * * *